US005931064A

United States Patent [19]

Gillespie

[11] Patent Number: 5,931,064

[45] Date of Patent: Aug. 3, 1999

[54] CABLE INSERTION TOOL

[76] Inventor: Harvey D. Gillespie, 4848 S. 2200 West, Salt Lake City, Utah 84118

[21] Appl. No.: 09/114,198

[22] Filed: Jul. 13, 1998

[51] Int. Cl.[6] ..... B25B 13/04

[52] U.S. Cl. ..... 81/120; 81/121.1; 405/259.1

[58] Field of Search ..... 81/120, 121.1, 81/125; 7/138, 107; 405/259.1, 302.2

[56] References Cited

U.S. PATENT DOCUMENTS

| | | | |
|---|---|---|---|
| 906,040 | 12/1908 | Lucas | 81/120 |
| 1,590,200 | 6/1926 | McGuckin | 81/120 |
| 3,161,090 | 12/1964 | McLellan | 81/120 |
| 4,784,531 | 11/1988 | Calandra, Jr. | 405/259.6 |
| 5,230,589 | 7/1993 | Gillespie | 405/259.1 |
| 5,551,320 | 9/1996 | Horobec et al. | 81/120 |
| 5,560,740 | 10/1996 | Castle | 405/259.6 |
| 5,699,572 | 12/1997 | Castle et al. | 7/138 |

*Primary Examiner*—David A. Scherbel
*Assistant Examiner*—Joni B. Danganan
*Attorney, Agent, or Firm*—Prince, Yeates & Geldzahler

[57] ABSTRACT

An insertion tool for inserting a multi-strand twisted cable into a blind mine tunnel roof bore hole includes a drive mechanism on one end thereof for fitting into a conventional bolting machine, and a socket on the opposite end thereof for receiving therein the bare end of a multi-strand twisted cable. The insertion tool socket is formed in the reverse pattern of the circumferential configuration of a conventional seven-strand twisted steel cable, having six essentially semi-cylindrical elongate and parallel arcuate channels formed therein in a spiral identical to that of the outside surfaces of respective cable strands of the twisted cable. The insertion tool is used by inserting, with a slight twisting action in the direction of the cable strand spiral, the bare end of the multi-strand steel twisted cable into the insertion tool socket mechanism. The opposite end of the insertion tool is then fitted into a conventional bolting machine boom arm for driving the multi-strand cable, via the insertion tool, into the bore hole in the mine tunnel roof in a manner similar to that in which the bolting machine would insert a conventional headed mine roof anchor bolt or multi-strand cable.

4 Claims, 4 Drawing Sheets

CABLE INSERTION TOOL

BACKGROUND OF THE INVENTION

1. Field of the Invention

The present invention relates to an insertion tool, and more particularly relates to an insertion tool for inserting a multi-strand twisted cable into a blind hole, and more particularly relates to an insertion tool that is adapted to fit onto the outer surface of a multi-strand twisted cable, as opposed to an insertion device that grips onto a sleeve, collar, head, shaft or other driving means for the cable.

2. Description of the Prior Art

In underground mining, it is conventional practice to support a mine tunnel roof by boring holes up into the roof and thereafter inserting elongate "rock anchors" into these holes, using a conventional bolting machine. Such a bolting machine includes an extended boom arm having a rotating and driving means on the end thereof in a manner to accept the shank of a drill bit and rotate and urge the drill bit up into the bore hole, thereby drilling the bore hole in the mine tunnel roof. The boom arm driving means is then used to rotate and drive the elongate rock anchor into the bore hole. Thereafter, the rock anchor is tightened in order to put the roof rock formation (rock, earth, etc.) above the main tunnel roof into compression, thereby tightening the formation and lowering its potential for fracture, deformation, and therefore failure. Other types of elongate rock anchors are cemented or grouted into these mine roof bore holes in order to adhere the mine roof rock formation to the rock anchor in a manner that the rock anchor both supports the mine tunnel roof rock formation directly above the tunnel, and also is supported by the material above that.

Customarily, these rock anchors have been formed of solid elongate bolts or steel rods having heads formed on one end thereof, the head being utilized as a conventional bolt head to: (1) drive the elongate rock anchor up into the hole in the mine tunnel roof; and (2) in combination with a large flat washer and what are called "roof mats", support the mine tunnel roof rock formation directly above the roof.

The last few years have seen the introduction of a flexible multi-strand steel cable as this elongate rock anchor, in place of a rigid elongate bolt or steel rod, in certain types of rock and earth formation above the mine tunnel. In order to utilize a cable in place of a steel headed bolt in this application, it has heretofore been necessary to install a head or some sort of driving and retaining mechanism on the end of the cable that could be utilized by the bolting machine to insert the cable up into the mine tunnel roof blind bore hole. The bolting machine has been used to install the solid bolts and shafts, and also cable sections having a driving head affixed on one end thereof.

It has been determined that in certain rock formations, a bolt head becomes unnecessary to retain the rock formation in compression, because of the fact that the rigid bolt (or cable as the case may be) is cemented or grouted to the interior of the mine roof bore hole along essentially its entire length, thereby removing the possibility of additionally compressing the rock formation above the mine roof once the mine roof bolt or cable is installed. In these situations, it is apparent that the head formed on the rigid bolts or rods and attached to the end of a section of cable was necessary only for inserting the bolt, rod or cable up into the mine tunnel roof bore hole. Once the rock anchor was cemented or grouted in place inside the bore hole, the head used to insert the anchor into the bore hole became essentially useless.

Inasmuch as conventional mine roof bolts are relatively inexpensively formed with heads thereon, it is common practice to use the head to insert the bolt into the mine roof bore hole in the conventional manner. However, when utilizing a multi-strand twisted steel cable as the rock anchor, it became a relatively expensive process to form and attach a headed member on one end of the cable for single purpose of installing the cable in a mine roof bore hole.

OBJECTS OF THE INVENTION

It is therefore an object of the present invention to provide an insertion tool for use with a section of multi-strand twisted steel cable in order to insert the cable up into a mine tunnel roof blind bore hole.

It is an additional object of the present invention to provide such an insertion tool that does not require a head formed on the end of a section of multi-strand twisted steel cable in order to install the cable into a mine tunnel roof blind bore hole.

It is a further object of the present invention to provide an insertion tool that engages the outside surface of a section of multi-strand twisted steel cable for inserting and rotating the cable into a mine tunnel roof blind bore hole.

It is a still further object of the present invention to provide an insertion tool for inserting headless bare ends of multi-strand twisted steel cable into mine tunnel roof bore holes by the use of conventional mine tunnel roof bolting machines.

It is a still further object of the present invention to provide an insertion tool for inserting a multi-strand twisted steel cable into a mine tunnel roof blind bore hole that enables the cable to be both rotated and translated linearly into the blind bore hole.

It is a still further object of the present invention to provide an insertion tool for inserting a section of multi-strand twisted steel cable into a mine tunnel roof blind bore hole that not only prevents the cable from untwisting as it is rotated and linearly translated into the borehole, but also tightens the "twist" of the cable section as it is rotated and translated into the blind bore hole.

SUMMARY OF THE INVENTION

An insertion tool for inserting a multi-strand twisted cable into a blind mine tunnel roof bore hole includes a drive mechanism on one end thereof for fitting into a conventional bolting machine, and a socket on the opposite end thereof for receiving therein the bare end of a multi-strand twisted cable. The insertion tool socket is formed in the reverse pattern of the circumferential configuration of a conventional seven-strand twisted steel cable, having six essentially semi-cylindrical elongate and parallel arcuate channels formed therein in a spiral identical to that of the outside surfaces of respective cable strands of the twisted cable. The insertion tool is used by inserting, with a slight twisting action in the direction of the cable strand spiral, the bare end of the multi-strand steel twisted cable into the insertion tool socket mechanism. The opposite end of the insertion tool is then fitted into a conventional bolting machine boom arm for driving the multi-strand cable, via the insertion tool, into the bore hole in the mine tunnel roof in a manner similar to that in which the bolting machine would insert a conventional headed mine roof anchor bolt or multi-strand cable.

DETAILED DESCRIPTION OF THE PREFERRED EMBODIMENT

Figure 1:
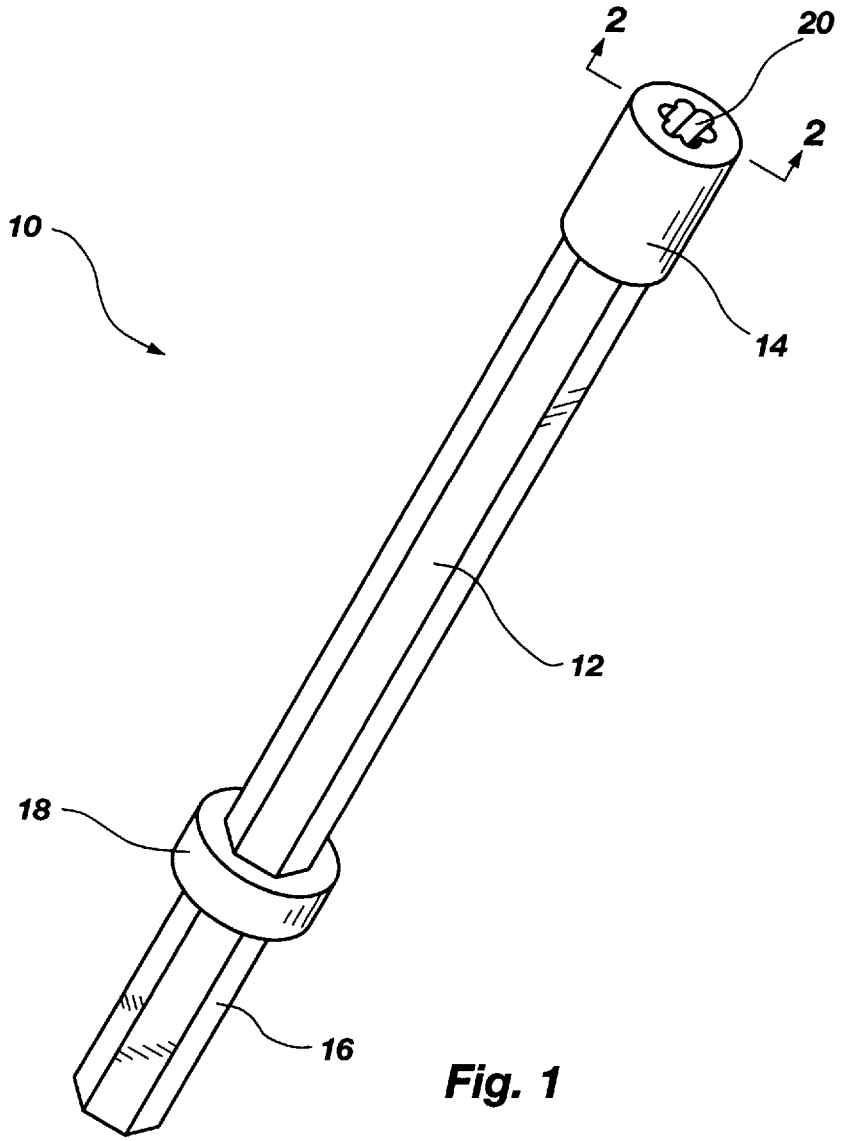
FIG. 1 is a perspective view of the cable insertion of the present invention.

Referring to the drawings, and initially to FIG. 1, the insertion tool of the present invention is shown generally illustrated by the numeral 10, to comprise an elongate shaft 12, having a head 14 at one end thereof and driving means 16 at the other end thereof. The preferred embodiment also includes a collar 18 formed adjacent the driving means for positioning the insertion tool within a bolting machine boom drive socket, as will be explained in greater detail hereinbelow.

The insertion tool head 14 includes socket means 20 for receiving therein the end of a bare-ended, multi-strand twisted steel cable for driving the cable into or through a hole. As can be appreciated, the head and socket means 20 of the insertion tool are in axially longitudinal alignment with the driving means 16 such that rotation of the driving means will similarly rotate the insertion tool head and socket means.

Figure 2:
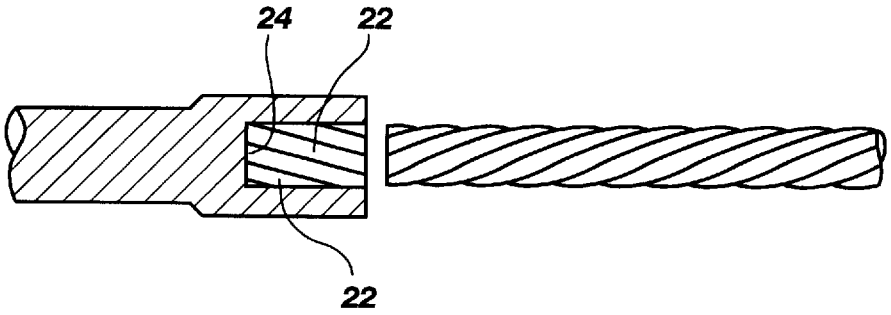
FIG. 2 is a partial sectional view of the top end of the insertion tool shown in FIG. 1, the section taken along the longitudinal axis thereof, illustrating the socket means for receiving the end of a multi-strand twisted steel cable thereinto.

FIG. 2 better illustrates the formation of the socket means 20, and in particular, the plurality of elongate arcuate channels 22 formed on the interior circumference of the socket means, and terminating in a blind end 24. These elongate arcuate channels 22 are formed to closely match the outer periphery a multi-strand twisted steel cable, such that with the cable inserted into the socket means, the cable will not twist or rotate relative to the insertion tool.

In a preferred embodiment, the socket means is approximately two inches deep for a No. 6 steel cable, which is approximately 6/10 inches in diameter. In this manner, the appropriate size multi-strand twisted steel cable can be inserted into the socket means and come to rest against the blind end 24.

As shown best in FIG. 1, the driving means 16 comprises a hexagonal head or shaft that is adapted to be received within the driving socket of the boom of a conventional underground mine roof bolting machine. It should be apparent that the shape of this driving means 16 may be of any configuration to accommodate various underground mine roof bolting machine driving sockets. In addition, the collar 18 is provided adjacent the driving means 16 to prevent the insertion tool from slipping longitudinally relative to the mine tunnel roof bolting machine driving socket.

As best shown in FIG. 1, the elongate arcuate channels 22 of the socket means are arcuate-shaped and are slightly twisted in a slight spiral orientation, as opposed to direct linear orientation and parallel with the insertion tool longitudinal axis, so that they precisely match the outside exposed surfaces of corresponding strands of a multi-strand twisted steel cable.

Figure 3:
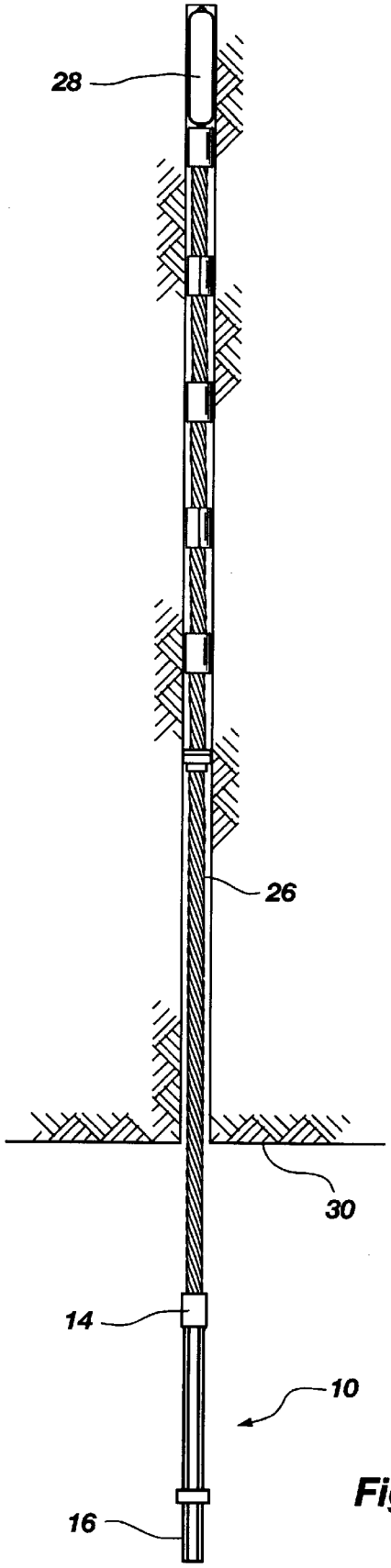
FIG. 3 is a vertical sectional view of a side elevation of a cable rock anchor being inserted into a mine tunnel roof blind bore hole by the use of the insertion tool of the present invention.

FIG. 3 illustrates a length of multi-strand twisted steel cable (commonly called a cable bolt) being inserted up into a mine tunnel roof blind bore hole. As shown, the upper end of the cable bolt is urged against the end of an epoxy resin cartridge 28; therefore, the free end of the cable bolt extends from the surface of the mine tunnel roof 30 a distance slightly more than the length of the epoxy resin cartridge. Not shown is the conventional mine tunnel roof bolting machine with its boom and driving socket into which the driving means 16 of the insertion tool 10 customarily fits. It can be appreciated, however, that, with the end of the cable bolt 26 inserted into the insertion tool head 14, the mine tunnel roof bolting machine rotates and translates the cable bolt 26 up into the mine tunnel roof blind bore hole and into engagement with the epoxy resin cartridge.

Figure 4:
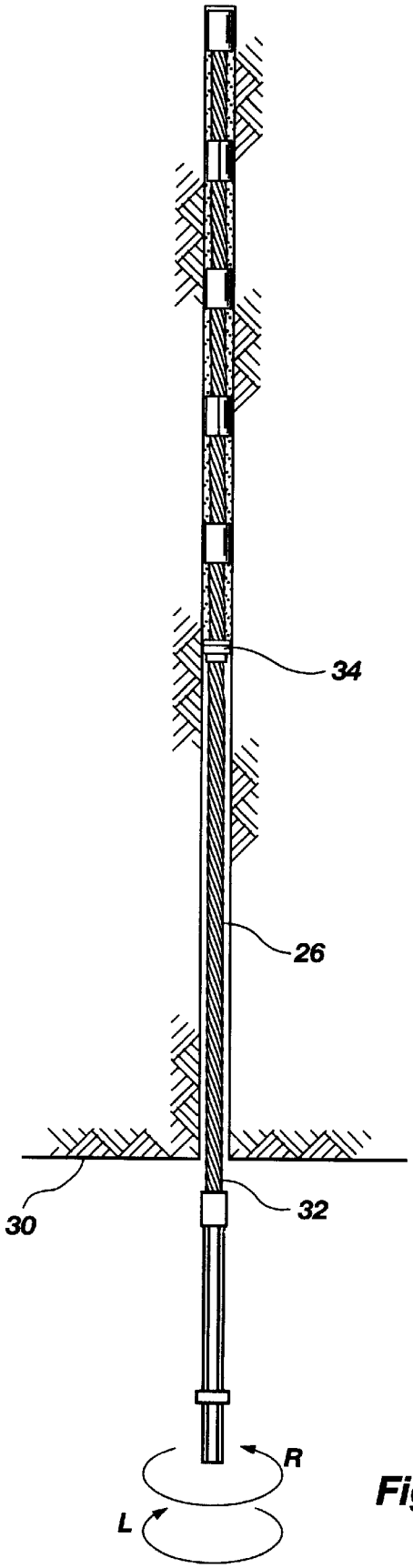
FIG. 4 is a view similar to FIG. 3, illustrating the cable rock anchor fully inserted into the mine tunnel roof blind bore hole.
Figure 5:
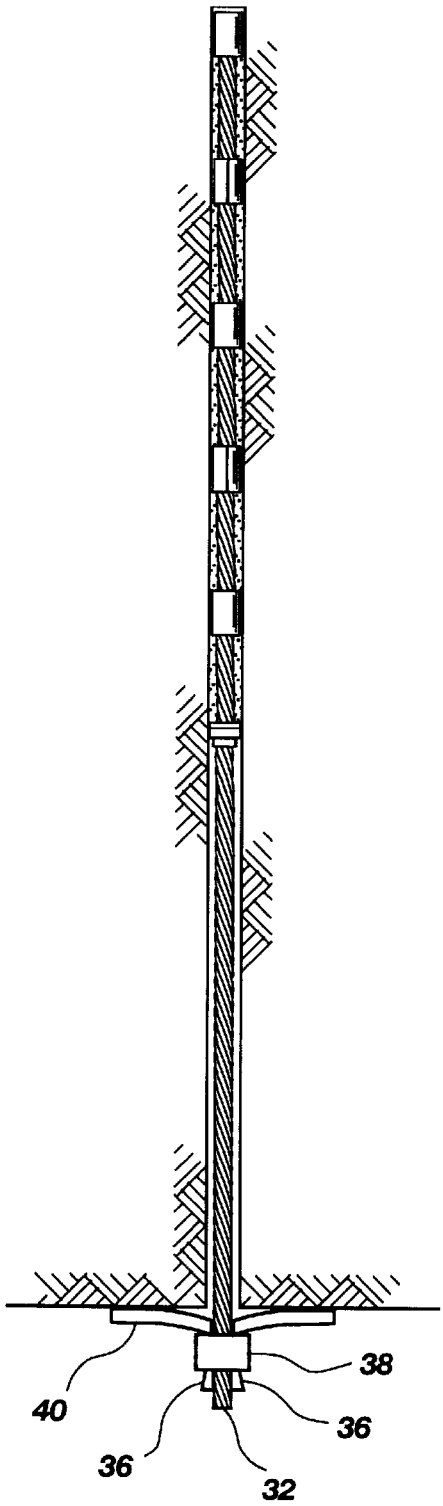
FIG. 5 is a view similar to FIGS. 3 and 4, showing the cable rock anchor "anchored" in the blind bore hole by a barrel and wedge mechanism pressed onto the free end of the cable.

FIG. 4 illustrates the cable bolt 26 having been driven all the way into the mine tunnel roof bore hole to the point that it has ruptured the epoxy resin cartridge and mixed and disbursed the epoxy resin into the annulus surrounding the cable bolt in a manner to adhere the cable bolt to the interior wall of the blind bore. So installed, the free end 32 of the cable bolt extends from the mine tunnel roof surface 30 a distance of approximately six inches for purposes of attaching a barrel and wedge mechanism to the cable bolt for compressing that section of mine tunnel roof rock formation between the roof surface 30 and a resin washer 34. This is shown in FIG. 5, which illustrates the cable bolt 26 in functional and loaded position within the mine tunnel roof blind bore hole. Specifically, following "setting" of the epoxy resin material around the cable bolt, the insertion tool is removed from the bolt by a reversal of the axial or longitudinal force on the insertion tool and a slight rotation in the direction opposite that of inserting the cable bolt. I.e., the removal rotation direction of a right-hand twist multi-strand steel cable would be in the right-hand direction, as shown by arrow R in FIG. 4.

Following removal of the insertion tool, the cable bolt 26 is tensioned in a customary manner by pulling on the free end 32 of the cable bolt while simultaneously urging a set of wedges 36 into a complimentary barrel 38 to urge the barrel up against a roof plate 40 for putting the rock formation directly above the mine tunnel roof into a compressed state.

OPERATION

The procedure for using the insertion tool of the present invention to install a multi-strand twisted steel cable mine roof bolt as shown in the drawings is very similar to the conventional procedure for installing "headed" mine roof bolts, both rigid and cable. Specifically, the free "upper" end of the cable is inserted up into the mine tunnel roof blind bore hole, with or without a supplemental anchoring mechanism attached to the top end thereof, and generally following insertion of one or more epoxy resin cartridges into the blind bore. With the insertion tool 10 previously fitted into the mine tunnel roof bolting machine boom driving socket, the bare free (lower) end of the multi-strand twisted cable is inserted into the socket means 20 of the insertion tool head with either a slight rotation of the insertion tool in a direction L as shown in FIG. 4, a slight rotation of the cable bolt in the direction R as shown in FIG. 4, or a combination of both, in order to "screw" the cable bolt free end 30 into the insertion tool socket means in a manner similar to the manner in which a conventional headed cable bolt would be fitted into the driving socket of a bolting machine boom.

With the bare end 32 of the cable bolt inserted into the insertion tool, the insertion tool is rotated in the direction of twist of the cable, i.e., in the righthand direction R as shown in FIG. 4 for a right-hand twist cable, in the direction to tighten the twist of the cable against rotational resistance provided at the opposite (upper) end of the cable. Simultaneously therewith, the cable bolting machine translates the cable bolt upward into the mine tunnel roof blind bore hole in the conventional manner to drive the cable bolt into the bore hole, rupturing the epoxy resin cartridge, and mixing and disbursing the epoxy resin in the annulus around the cable bolt.

When the cable bolt is fully inserted into the mine tunnel roof blind bore, as determined by resistance to further linear translation of the bolt into the hole, and by the length of the cable bolt protruding from the mine tunnel roof, the cable bolt is forcibly retained in the mine roof bore hole for a period of time to permit the epoxy resin to set—from 30 seconds to three minutes, depending on the particular resin. Following setting of the epoxy resin, axial force is removed from the cable bolt, and the insertion tool is rotated slightly in the same direction as it is for cable insertion (in the direction of arrow R in FIG. 4) as it is backed away from the end 32 of the cable bolt. In this manner, the insertion tool is "unscrewed" from the cable bolt end, leaving the cable bolt intact within the mine roof bore hole and the end 32 of the cable bolt protruding from the mine tunnel roof surface approximately six inches. At this point, the cable bolt may be "post-tensioned" and the roof plate, barrel, and wedge assembly installed around the free end of the cable bolt in a conventional manner.

From the foregoing it will be seen that this invention is one well adapted to attain all of the ends and objectives herein set forth, together with other advantages which are obvious and which are inherent to the composition and method. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. An insertion tool for inserting a bare-ended, multi-strand cable into a hole, the insertion tool comprising:

a shaft having a central longitudinal axis;

a head formed with a first end of the shaft, the head having socket means formed therein, the socket means comprising a plurality of elongate arcuate channels oriented in a spiral orientation in a manner to receive therein the end of a length of bare-ended, multi-strand cable for applying axial and rotating forces to the cable for rotating and inserting the cable into the hole; and driving means formed with the second end of the shaft, the driving means designed to be received into a conventional driving socket for rotating and driving the insertion tool.

2. An insertion tool as set forth in claim 1, wherein the driving means and head socket means are co-axial with the shaft central longitudinal axis.

3. An insertion tool as set forth in claim 1, wherein the driving means comprises a hexagonal head.

4. A method of inserting a bare-ended, multi-strand twisted cable into a hole, comprising:

inserting a first end of the cable into the hole;

inserting a second end of the cable into an insertion tool having:

a shaft having a central longitudinal axis;

a head formed with a first end of the shaft, the head having socket means formed therein, the socket means comprising a plurality of elongate arcuate channels oriented in a spiral orientation in a manner to receive therein the end of a length of bare-ended cable for applying axial and rotating forces to the cable for rotating and inserting the cable into the hole; and driving means formed with the second end of the shaft, the driving means designed to be received into a conventional driving socket for rotating and driving the insertion tool; and rotating and translating the driving means in the axial direction of the cable and in the rotational direction opposite that of the cable twist until the cable is fully inserted into the hole.

* * * * *